US005387129A

United States Patent [19]

Hotea

[11] Patent Number: 5,387,129

[45] Date of Patent: Feb. 7, 1995

[54] SEALED ELECTRICAL CONNECTOR AND METHOD OF MAKING THE SAME

[75] Inventor: Gheorghe Hotea, Griesheim, Germany

[73] Assignee: The Whitaker Corporation, Wilmington, Del.

[21] Appl. No.: 67,375

[22] Filed: May 26, 1993

[30] Foreign Application Priority Data

Jun. 16, 1992 [GB] United Kingdom ..... 9212732

[51] Int. Cl.[6] ..... H01R 13/52

[52] U.S. Cl. ..... 439/587; 439/276; 439/936

[58] Field of Search ..... 439/271, 274–276, 439/587, 936; 29/841

[56] References Cited

U.S. PATENT DOCUMENTS

| | | | |
|---|---|---|---|
| 4,133,593 | 1/1979 | Moulin | 439/274 |
| 4,335,932 | 6/1982 | Herrmann | 439/587 |
| 5,000,695 | 3/1991 | Nishiyama et al. | 439/276 |

*Primary Examiner*—Eugene F. Desmond
*Attorney, Agent, or Firm*—Eric J. Groen; Timothy J. Aberle

[57] ABSTRACT

An electrical connector having an improved seal for sealing a terminal area of the electrical connector. The seal has an engaging surface having a groove extending around the perimeter of the seal, thereby defining a first and second wall. The seal is slidably mounted on a cable, and the cable and seal are inserted in an end of the electrical connector so that a channel is formed by the groove and an inner wall of the electrical connector housing. A sealing material is introduced into the end of the electrical connector until it penetrates the seal between the first wall and the inner wall, thereby causing the channel to become filled with the sealing material. The seal provides a heat sink so that the sealing material solidifies in the channel without penetrating the seal between the second wall and the inner wall, thereby sealing the terminal area of the electrical connector from unwanted moisture.

17 Claims, 5 Drawing Sheets

SEALED ELECTRICAL CONNECTOR AND METHOD OF MAKING THE SAME

BACKGROUND OF THE INVENTION

1. Field of the Invention

This invention relates to an electrical connector, and more particularly, it relates to a sealed electrical connector and to a method for making a sealed electrical connector.

2. Description of the Prior Art

Electrical connectors used outdoors, such as those used in automobiles, must be made waterproof to prevent water from contacting electrical terminals inside the electrical connector. Typically, terminals within the electrical connector are sealed by placing a seal, such as an O-ring, around the cable, such that the seal is in sealing engagement with an inner wall of the housing of the electrical connector. As an alternative to providing a discrete seal, it is also known to inject a sealing compound into the end of the connector, through the wire receiving opening, such that it fills the void surrounding the wire. While this provides an excellent seal, it is often difficult to control the flow of the injected sealant, and it could, due to the injection pressure, continue forward to partially fill the terminal itself, and could, due to its insulating nature, make an ineffective contact.

It is therefore, an object of this invention to provide a seal for use in an electrical connector which has improved means for enabling the electrical connector to receive the sealing material and also for preventing unwanted materials or moisture from penetrating the terminal area of the electrical connector.

Another object of this invention is to provide a seal which provides a heat sink which facilitates causing the sealing material to solidify between the seal and an inner wall of the electrical connector.

Still another object of this invention is to provide a seal having a groove around a peripheral edge thereof, wherein the groove is capable of receiving the sealing material and is also capable of preventing a sealing material from penetrating a terminal area of an electrical connector.

Yet another object of this invention is to provide a seal which is simple in design and which is easy and inexpensive to manufacture.

Still another object of the invention is to provide a method for sealing a terminal area in an electrical connector.

These objects and other objects will become more apparent from the following specification, claims and drawing.

SUMMARY OF THE INVENTION

The objects of the invention were accomplished by providing a seal for use in an electrical connector having an inner wall which defines an inner passageway; said seal comprising a body portion comprising an inner sealing surface adapted to be in sealing engagement with a cable; said body portion also comprising an outer sealing lip having a predetermined configuration which is adapted for slidable receipt within said inner wall; said predetermined configuration permitting a sealing material which is introduced into said inner passageway to seal a terminal area of said inner passageway.

In another aspect of the invention a sealed electrical connector comprises an insulating connector housing having at least one electrical contact therein, the housing having a terminal receiving passageway for housing the at least one contact therein. The contact resides within a contact area within the passageway, the passageway further including a cavity rearwardly of the terminal area for receipt of a wire to which the contact is connected, the connector further comprising a heat sink sleeve slidably receivable over the wire and adaptable for slidable receipt within the cavity. The cavity is filled with the sealant to sealingly enclose the cavity and the sealent is cooled by the heat sink sleeve and solidified.

An inventive method of providing a sealed electrical connector where the connector comprises an insulating housing containing at least one terminal terminated to an electrical wire, and positioned within a passageway with the housing, where the housing includes a rear cavity providing access to said passageway, the inventive method comprises the steps of: injecting a sealant material into the housing cavity and cooling the injected material at a position rearward of said termination such that the sealant solidifies and prevents further forward movement of the sealant.

DETAILED DESCRIPTION OF THE PREFERRED EMBODIMENT

Figure 1:
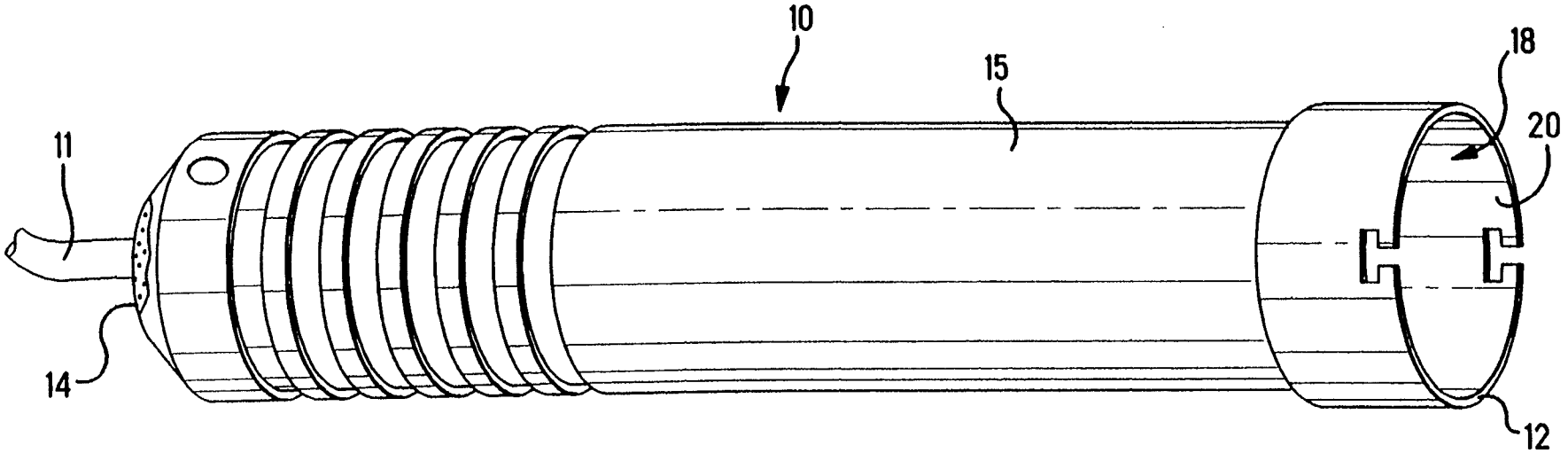
FIG. 1 is a side view of an electrical connector in which an embodiment of this invention may be used.

FIG. 1 is a side view of an electrical connector assembly, hereinafter designated as connector assembly 10, made according to the present invention. The connector assembly 10 comprises a housing 15 having a mating end 12 and a cable receiving end 14. The connector assembly 10 also comprises a pin insert housing 16 (FIGS. 2A and 2B) which is conventionally received in a terminal receiving passageway 18 defined by an inner wall 20 of the housing 15. The inner wall 20 also defines a terminal area 24 which is associated with the cable receiving end 14. The pin insert housing 16 is positioned towards the mating end 12 of the connector assembly 10, and it enables the connector assembly 10 to be secured to a complementary mating electrical connector (not shown). Although not shown, the pin insert housing 16 could be either a male or female pin insert housing. The structure and function of the connector assembly 10, pin insert housing 16 and terminal receiving passageway 18 is substantially equivalent to the structure shown in European patent application serial number 0 424 892 which is assigned to the assignee as the present application and which is hereby incorporated by reference and made a part hereof.

Figure 3:
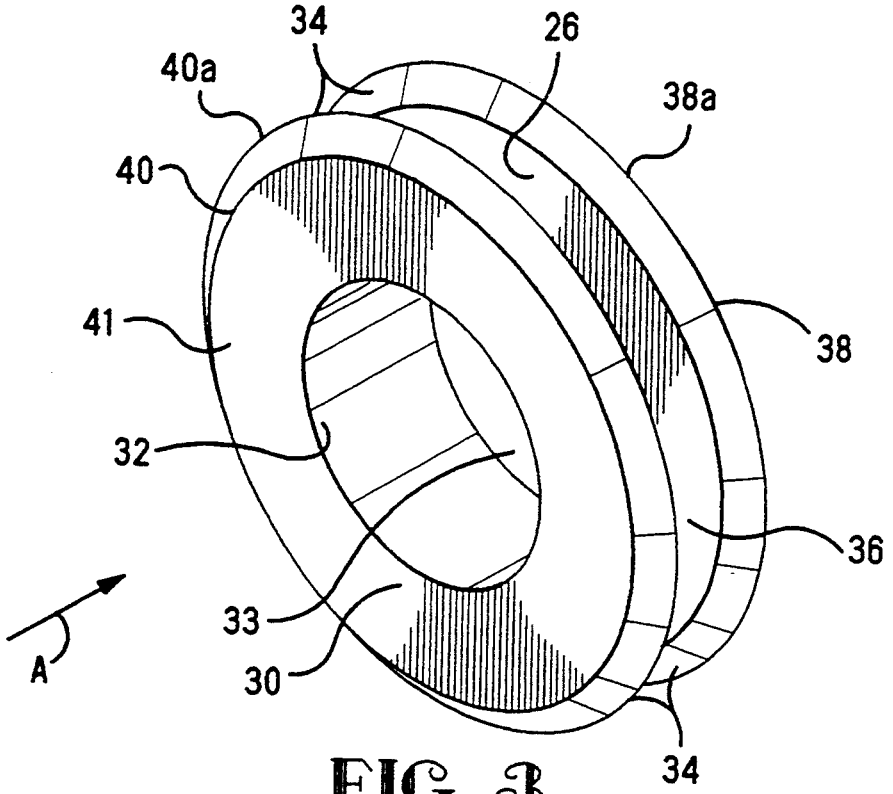
FIG. 3 is an enlarged isometric view of the seal used in the electrical connector.
Figure 4:
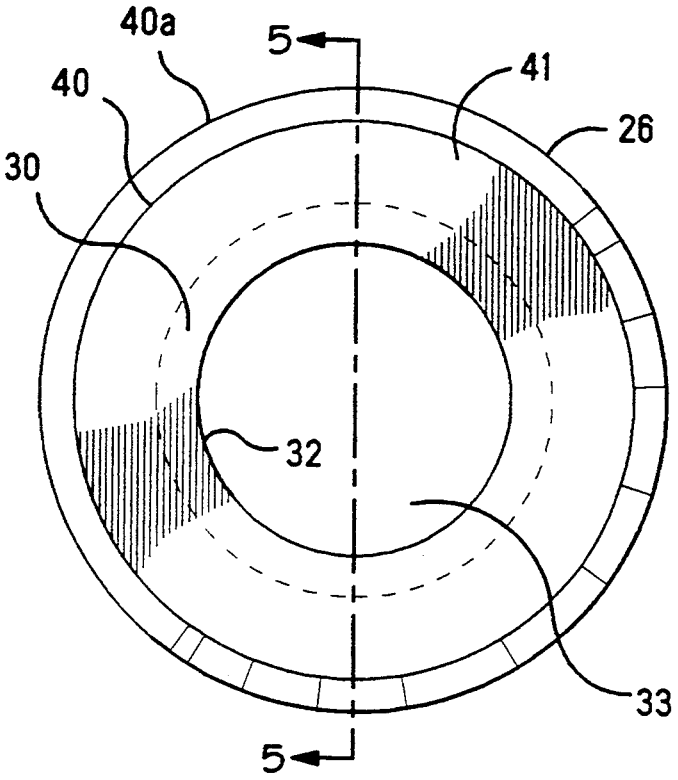
FIG. 4 is a view, taken in the direction of Arrow A in FIG. 3, showing details of the seal shown in FIG. 3.
Figure 5:
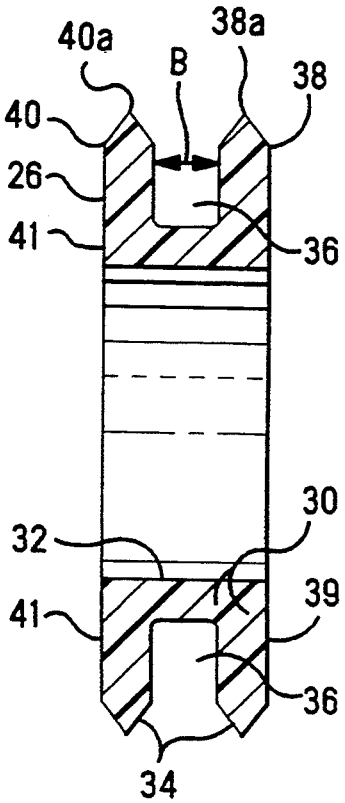
FIG. 5 is a section view, taken along the line 5-5 in FIG. 4, showing details of the seal.

The connector assembly 10 also comprises a sealing insert 26 (FIGS. 2A, 2B, and 3–5) which facilitates the sealing of the terminal area 24 from both unwanted moisture as will be described later herein. In the embodiment being described, the seal 26 is toroidal in shape, and as best shown in FIGS. 3–5, comprises a body portion 30 having an inner surface 32 which defines a cable aperture 33. The inner surface 32 is adapted for slidably receiving the cable 11 when the seal 26 is placed thereon. The body portion 30 also comprises an outer sealing lip 34 having a predetermined configuration which is adapted for slidable receipt against the inner wall 20 (FIGS. 2A and 2B) when the insert 26 is placed on the cable 11 and the cable 11 and insert 26 are positioned in the terminal area 24.

The predetermined configuration of the insert 26 permits sealing material 28 to be introduced into the opening 17 of the cable receiving end 14 of the housing 15 so that the sealing material 28 cooperates with the inner wall 20 in order to seal the terminal area 24. In the embodiment being described, the predetermined configuration comprises a groove 36 in the outer sealing lip 34. The function of the groove 36 is to cooperate with the inner wall 20 to define a channel 37 (FIGS. 2A and 2B) for receiving the sealing material 28. As shown in FIG. 5, the groove 36 is generally U-shaped when viewed in radial cross-section. The groove 36 defines a first wall 38 and a second wall 40 which are in a generally opposed and parallel relationship. The body portion 30 and the walls 38, 40 provide a heat sink which facilitates causing the sealing material 28 to solidify in the channel area 37 (FIG. 2A) defined by the generally U-shaped groove 36 and the inner wall 20. In the embodiment being described, the sealing insert 26 is a one-piece construction molded from a plastic material.

Figure 2A:
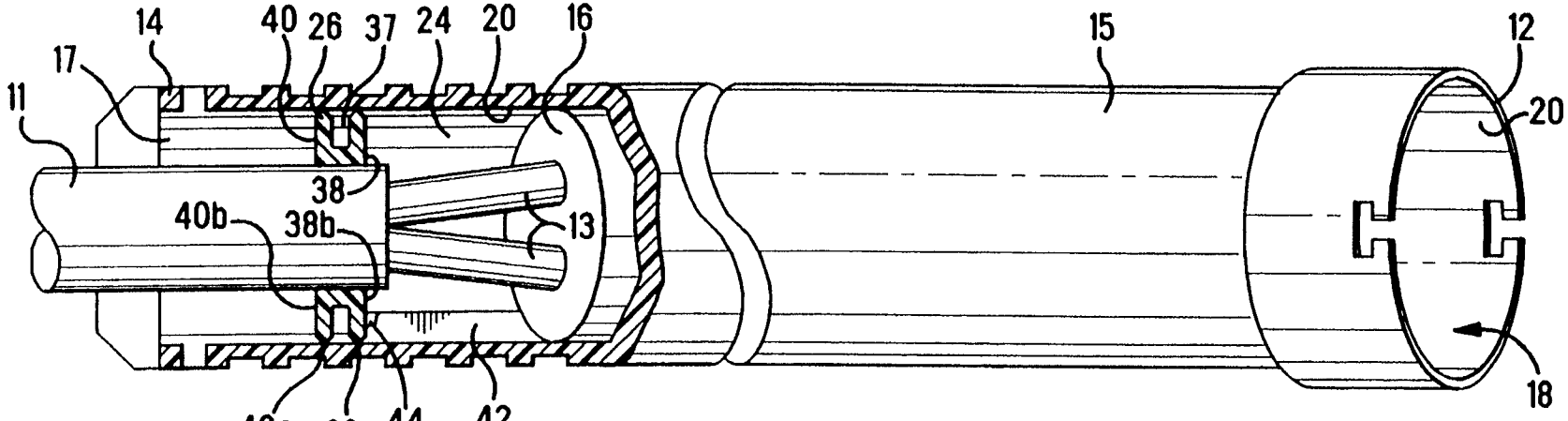
FIG. 2A is a fragmentary view, partially broken away, showing a sealing insert positioned in the electrical connector.
Figure 2B:
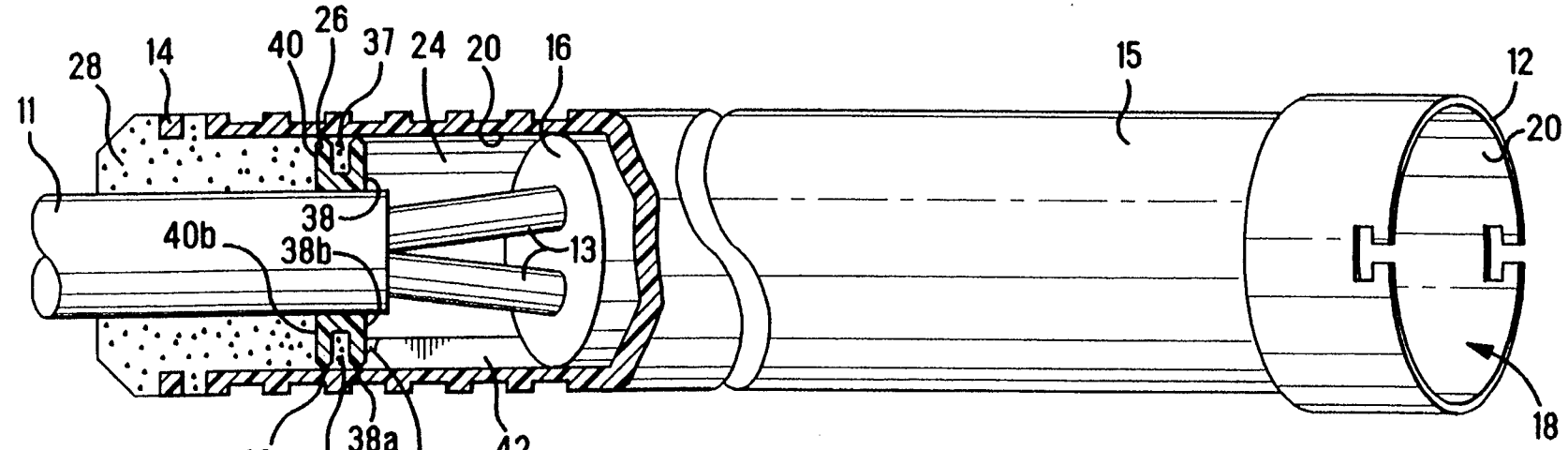
FIG. 2B is a fragmentary view similar to FIG. 2A, showing a sealing material injected into the housing of the electrical connector.

As best illustrated in FIGS. 2A, 2B and 5, the first and second walls 38 and 40 have edges **38*a* and 40*a*. In the embodiment being described, the sealing edges 38*a* and 40*a* are generally V-shaped when viewed in cross-section, and they are profiled with a slight amount of clearance between the edges 38*a*, 40*a* and the inner wall. The first and second walls 38 and 40 are annular in shape and are located a predetermined distance (indicated by double Arrow B in FIG. 5) apart. A method of sealing the terminal area 24 using the insert 26** will now be described.

After the wires 13 of the cable 11 are conventionally coupled to the pin insert housing 16, the pin insert housing 16 is mounted in the terminal receiving passageway 18 in the manner described in the above mentioned European patent application, so that the pin insert housing 16 becomes operatively associated with the mating end 12 of the connector assembly 10. The insert 26 is slidably mounted on the cable 11 and then inserted or moved into the cable receiving end 14 of the connector assembly 10. The insert 26 is inserted into the cable receiving end 14 and moved towards the pin insert housing 16 until an engaging surface **38*b* of the first seal wall 38 engages a first shoulder member 42 (FIGS. 2A and 2B) and a second shoulder member 44 which are integrally formed as part of the housing 15**.

In order to facilitate sealing the terminal area 24 from unwanted moisture and precipitation, a molten or liquid sealing material 28 is introduced or injected into the opening 17 of the cable receiving end 14 until the sealing material 28 engages the engaging surface **40*b* of the second seal wall 40. In the embodiment being described, the sealing material 28 may be any conventional liquid sealing overmold material. As the sealing material 28 is forced into the opening 17 at the cable receiving end 14, the sealing material flows past the sealing edge 40*a* and thereafter into the channel area 37 defined by the groove 36 and the inner wall 20. Due to the low flow resistance, the sealant fills the void 37, rather than flowing beyond the second edge 40*b*. As mentioned previously herein, the insert 26 provide a heat-sink for absorbing heat from the sealing material 28 so that the molten sealing material 28 within the channel area 37 begins to cool and therefore solidifies in the channel before the sealing material 28 can penetrate beyond the sealing edge 38*a*. This ensures that the sealing material 28 will not penetrate the terminal area 24, thereby effectively sealing the terminal area 24 from the sealing material 28 as well as any unwanted moisture or precipitation. It should be noted also that the sealing material 28 solidifies in the seal receiving end 14 to integrally couple both the cable 11 and the seal 26 to the inner wall 20 of the connector assembly 10**.

Advantageously then, the seal 26 provides the means for sealing the terminal area 24 of the connector assembly 10 so that neither the overmold sealing material 28 nor any unwanted precipitation can penetrate the terminal area 24.

Figure 6:
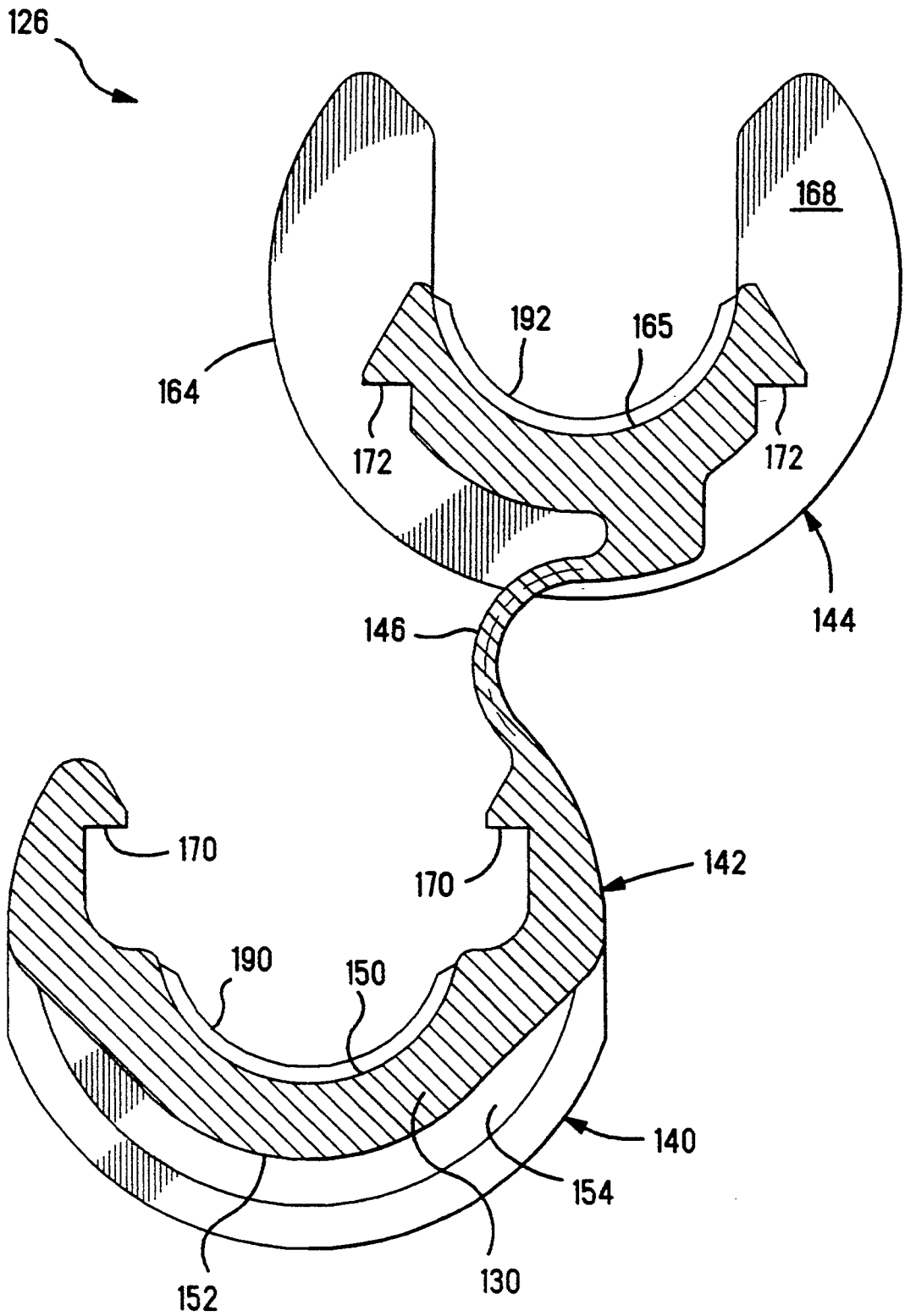
FIG. 6 is a cross-sectional view through an alternative sealing insert.
Figure 8:
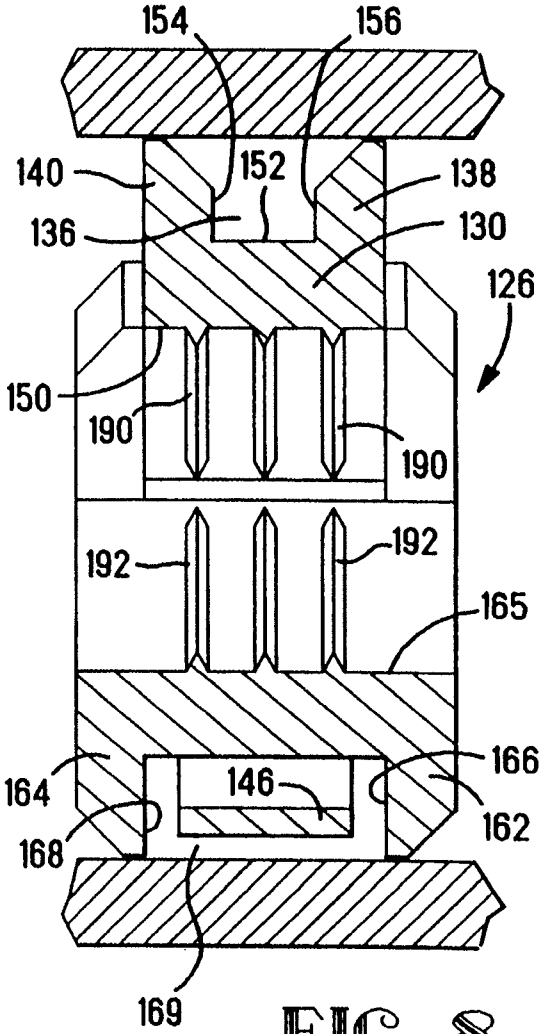
FIG. 8 is a cross-sectional view through lines 8—8 of FIG. 7.
Figure 7:
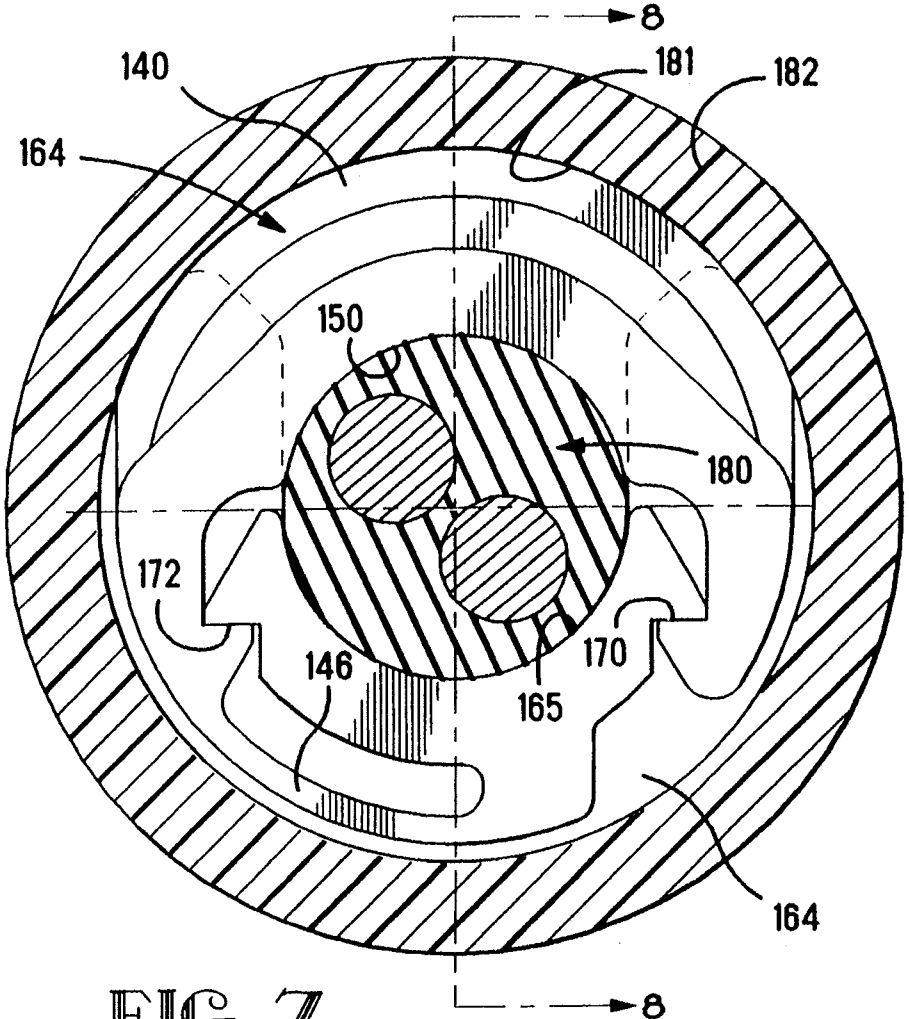
FIG. 7 is a view of the insert of FIG. 6 shown in the fully latched condition positioned in an outer housing shell.

With respect now to FIGS. 6–8, an alternate sealing insert is shown at 126 comprised of first and second insert halves 142 and 144 integrally connected by way of a web of material at 146. The insert half 142 includes a central body portion 130 having an inner diameter 150 and an outer diameter 152. First and second peripheral walls 138 and 140 (FIG. 8) extend upwardly from the outer diameter portion 152 and includes inner surfaces 154 and 156 thereby forming an internal passageway 136 therebetween. As shown best in FIG. 6, the insert portion 144 includes a central body portion 160 having peripheral walls 162 and 164 (FIG. 8) extending therefrom where the central body section 160 has an inner diameter shown at 165. The walls 162 and 164 have inner surfaces 166 and 168 respectively which receive therebetween the peripheral walls 138 and 140, as best shown in FIG. 8.

As shown in FIG. 6, the body portion 130 includes latching surfaces 170, whereas the body portion 160 include latching surfaces 172, the two halves 142 and 144 being overlappingly interlockable into the position shown in FIG. 7 where the inner diameters 150 and 165 provide a substantial cylindrical opening for a cable such as 180; and the walls 138, 140 and 162, 164 provide continous contact with an inner diameter 180 of an outer shell such as 182. As shown in FIG. 8, a peripheral cavity is formed at 136, 169 providing a continous cavity within the sealing insert which functions identically to the sealing insert shown in FIGS. 1–5. Additionally, the inner diameter 150 includes a strain relief barb 190 whereas the inner diameter 165 includes barbs 192 which bite into the outer diameter of the insulation jacket of the cable 180 for strain relief purposes.

Various changes or modifications in the invention may occur to those skilled in the art without departing from the true spirit or scope of the invention. For example, the seal 26 could be provided with a plurality of walls in addition to the first and second seal walls 38 and 40. Although the sealing edges **38*a* and 40*a* are shown as being generally V-shaped, they could be any shape which is capable of permitting the sealing material 28 to be introduced into the channel area 37 but which is also capable of preventing the sealing material 28 from penetrating the terminal area 24. Also, although the seal 26 has been described herein for use in either a female or male connector assembly 10, it could be used in other types of connectors (not shown) wherein it is desirable to seal an area (not shown) inside the connector. Although the housing 22 and the seal 26 have been shown as being generally cylindrical, they could be molded in other shapes, such as rectangular or square. In addition, the shape of the cable receiving aperture 33 which is defined by the inner surface 32**, could be some shape other than cylindrical in order to accommodate a cable having, for example, a generally rectangular shape. The above description of the invention is intended to be illustrative only and not limiting, and it is not intended that the invention be restricted thereto but that it be limited only by the true spirit and scope of the appended claims.

I claim:

1. A sealing insert for use in an electrical connector having an inner wall which defines an inner passageway; said sealing insert comprising:

a body portion comprising an inner sealing surface adapted to be in sealing engagement with a cable;

said body portion also comprising an outer sealing lip having a predetermined configuration which is adapted for slidable receipt within said inner wall;

said predetermined configuration permitting a sealing material which is introduced into said inner passageway to seal a terminal area of said inner passageway; and wherein said predetermined configuration comprises a groove in said outer sealing lip for receiving said sealing material.

2. The seal as recited in claim 1 wherein said groove is generally U-shaped in radial cross section.

3. The seal as recited in claim 1 wherein said body portion is toroidal in shape and said groove forms a single, continuous loop about the perimeter of said outer sealing lip.

4. The sealing insert as recited in claim 1 wherein said groove defines first and second walls which are in a generally opposed and parallel relationship;

said first and second walls cooperating with said inner wall of said electrical connector to permit said sealing material to enter and solidify in said groove, thereby facilitating sealing said terminal area of said inner passageway.

5. The sealing insert as recited in claim 4 wherein each of said first and second walls have sealing edges positioned adjacent to said inner wall of said electrical connector when said sealing insert is disposed in said inner passageway; said first seal wall being adapted to permit said sealing material to penetrate past said first seal wall and enter said groove whereupon said sealing material is retained in said groove between said first and second walls, thereby preventing said sealing material from penetrating said terminal area of said inner passageway.

6. The seal as recited in claim 4 wherein said first and second seal walls are annular in shape.

7. The sealing insert as recited in claim 1 wherein said sealing insert is a one-piece construction molded from a plastic material and said body portion provides a heat sink which facilitates causing said sealing material to solidify.

8. The sealing insert as recited in claim 7, wherein said sealing insert is comprised of two insert halves integrally connected together by way of a web of material, the two insert halves being snap latchable together.

9. A sealed electrical connector comprising:

an insulative housing providing a front mating face and a rear terminal receiving area, the rear terminal receiving area comprising a rear cavity having a peripheral wall surrounding at least one terminal receiving passageway;

a sealing insert having at least one cable receiving opening therethrough, and adapted for slidable receipt with said cavity;

at least one electrical contact terminated to an electrical conductor within a cable, said cable extending rearwardly through said cable receiving opening;

a sealing compound injected within said cavity, filling the void within said cavity rearwardly of said sealing insert; and wherein said insert contains at least one peripheral groove, and at least one cable opening.

10. The sealed connector of claim 9, wherein said peripheral wall has at least one engaging lug for preventing forward movement of said insert.

11. The sealed connector of claim 9, wherein a peripheral edge of said insert contains a groove, said insert being adapted to allow the injected material to flow around said peripheral edge into said groove, whereupon said insert acts as a heat sink, and said sealant solidifies in said groove, preventing further forward movement of said sealant.

12. The sealed connector of claim 9, wherein said peripheral wall is associated with said at least one concentric cable receiving opening.

13. A sealed electrical connector, comprising:

an insulating connector housing having at least one electrical contact therein, said housing having a terminal receiving passageway for housing said at least one contact therein, wherein said contact resides within a contact area within said passageway, said passageway further including a cavity rearwardly of said terminal area for receipt of a wire to which the contact is connected, the connector further comprising a heat sink sleeve, slidably receivable over the wire, and adapted for slidable receipt within the cavity, the cavity being filled with a sealant to sealingly enclose said cavity, said sealant being cooled by said heat sink sleeve and solidified.

14. The sealed electrical connector of claim 13, wherein said sleeve is a discrete sleeve profiled for receipt over only one wire.

15. The sealed electrical connector of claim 13, wherein the sleeve includes a peripheral groove on an outer periphery thereof, thereby forming a rearwardly and a forwardly facing wall, said sleeve being adapted to allow the injected sealant past said rearwardly facing wall and into said groove, wherein said sealant is solidified in said groove.

16. A method of providing a sealed electrical connector, where the connector comprises an insulating housing containing at least one electrical terminal terminated to an electrical wire, and positioned within a passageway of the housing, the housing further including a rear cavity providing access to said passageway, said method comprising the steps of:

positioning an insert, having a peripheral groove therearound, within the cavity with the cable protruding therefrom;

injecting sealant material into said housing cavity;

flowing said sealant material around said insert and into said groove; and cooling said injected material within said groove, such that said sealant solidifies therein and prevents further movement of said sealant.

17. The method of claim 16, wherein said cooling step is carried out by having said insert acting as a heat sink within said cavity.

* * * * *